US010190282B2

(12) United States Patent
Van Vessem et al.

(10) Patent No.: US 10,190,282 B2
(45) Date of Patent: Jan. 29, 2019

(54) PILE DRIVING ASSEMBLY AND A FOLLOWER

(71) Applicant: IHC HOLLAND IE B.V., Sliedrecht (NL)

(72) Inventors: Henricus Gerardus Andreas Van Vessem, Vught (NL); Jakob Van Dijk, The Hague (NL)

(73) Assignee: IHC HOLLAND IE B.V., Sliedrecht (NL)

( * ) Notice: Subject to any disclaimer, the term of this patent is extended or adjusted under 35 U.S.C. 154(b) by 0 days.

(21) Appl. No.: 15/563,418

(22) PCT Filed: Apr. 1, 2016

(86) PCT No.: PCT/NL2016/050225
§ 371 (c)(1),
(2) Date: Sep. 29, 2017

(87) PCT Pub. No.: WO2016/159770
PCT Pub. Date: Oct. 6, 2016

(65) Prior Publication Data

US 2018/0087233 A1 Mar. 29, 2018

(30) Foreign Application Priority Data

Apr. 2, 2015 (NL) ..... 2014578

(51) Int. Cl.
*E02D 7/26* (2006.01)
*E02D 13/10* (2006.01)
(Continued)

(52) U.S. Cl.
CPC ..... *E02D 13/10* (2013.01); *E02D 7/02* (2013.01); *E02D 7/28* (2013.01); *E02D 7/26* (2013.01)

(58) Field of Classification Search
CPC .... E02D 5/32; E02D 7/08; E02D 7/24; E02D 7/26; E02D 7/28
(Continued)

(56) References Cited

U.S. PATENT DOCUMENTS 1,023,243 A 4/1912 Clark
1,831,209 A * 11/1931 Thornley ..... E02D 5/385 175/424
(Continued)

FOREIGN PATENT DOCUMENTS

EP 0581688 A1 2/1994
EP 2481490 A1 8/2012
(Continued)

OTHER PUBLICATIONS

International Search Report dated Jul. 25, 2016 for corresponding International Application PCT/NL2016/050225, filed Apr. 1, 2016.
(Continued)

*Primary Examiner* — Sunil Singh
(74) *Attorney, Agent, or Firm* — Steven M. Koehler; Westman, Champlin & Koehler, P.A.

(57) ABSTRACT

A pile driving assembly for installing a pile in an underwater bottom comprises a tubular pile and a hammer for driving the pile into an underwater bottom. The assembly is provided with a soil remover for removing soil inside the pile. The soil remover is located below the hammer and remote from a lower end of the pile in assembled operating condition.

14 Claims, 6 Drawing Sheets

(51) Int. Cl.
*E02D 7/02* (2006.01)
*E02D 7/28* (2006.01)

(58) Field of Classification Search
USPC ..... 405/232, 245, 248, 249, 228, 224.1; 114/296, 297, 311; 173/132, 78, 80, 198, 173/199
See application file for complete search history.

(56) References Cited

U.S. PATENT DOCUMENTS 3,597,930 A 8/1971 Rochelle et al.
4,702,325 A * 10/1987 Hipp ..... E21B 6/00 173/61
5,449,253 A 9/1995 Roger
6,224,294 B1 * 5/2001 Mansfield ..... B63C 3/06 173/1
7,775,304 B2 * 8/2010 Luo ..... E21B 7/185 173/76

FOREIGN PATENT DOCUMENTS

GB 1089717 * 11/1967
GB 1089717 A 11/1967
JP 6-272250 * 9/1994

OTHER PUBLICATIONS

Written Opinion of the International Searching Authority dated Jun. 10, 2016 for corresponding International Application PCT/NL2016/050225, filed Apr. 1, 2016.

* cited by examiner

PILE DRIVING ASSEMBLY AND A FOLLOWER

CROSS-REFERENCE TO RELATED APPLICATION

The present application is a national stage of and claims priority of International patent application Ser. No. PCT/NL2016/050225, filed Apr. 1, 2016, and published in English as WO 2016/159770 A1.

BACKGROUND

The discussion below is merely provided for general background information and is not intended to be used as an aid in determining the scope of the claimed subject matter.

The present invention relates to a pile driving assembly for installing a pile in an underwater bottom, comprising a tubular pile and a hammer for driving the pile into an underwater bottom.

A known pile driving assembly of the applicant has a tubular pile to be installed in a ground formation and a hydraulic driver including an anvil, wherein the pile has an inwardly protruding circumferential collar at the inside of its upper portion remote from the top side. The known assembly is adapted such that the hammering energy is directly transmitted from the anvil to the pile via the collar. During installation of the pile the hydraulic driver drives the pile into the bottom, for example a seabed. Upon penetrating the bottom the soil material enters the tubular pile. The final position of the pile in the bottom is selected such that the collar inside the pile is below the initial bottom level at the start of driving the pile. This means that in practice in the final position the bottom level in the pile is lower than the bottom level adjacent the pile at the outer side thereof. It is noted that in the final position the pile may project above the bottom in order to prevent soil material from easily entering the pile from above directly after removing the hydraulic driver.

Since the anvil contacts the collar directly the anvil and/or the collar contact the soil material upon approaching the final position of the pile. This means that the soil material inside the pile is compacted during the final period of hammering. Consequently, after removing the anvil the bottom level inside the pile is lower than the bottom level adjacent the pile at the outer side thereof. The compacted soil provides a basis for placing a bearing element in the pile. For example, the pile may be a jacket pile and the bearing element may be a jacket leg of an offshore structure; the jacket leg can be anchored inside the jacket pile by adding grout to the pile.

A disadvantage of the known assembly is that in case of very dense soil material a high resistance arises as soon as the anvil and/or collar contact the soil material inside the pile. In such a case further compacting the soil material in the pile would be unnecessary.

SUMMARY

A pile driving assembly, which is suitable for dense soils. The assembly is provided with a soil remover for removing soil inside the pile, which soil remover is located below the hammer and remote from a lower end of the pile in assembled operating condition.

This provides the opportunity to operate the soil remover during pile driving. Furthermore, the inner side of a portion of the pile can be cleaned without interrupting the operation of pile driving. In case of very dense soil material, it can be removed out of the pile by the soil remover instead of compacting it. In practice the soil remover may be located inside the pile.

In a preferred embodiment the soil remover is located at an upper end portion of the pile, since this allows a large portion of the pile to be driven into the bottom without dislodging the bottom inside the pile, whereas soil removing can be performed only during driving the upper portion of the pile into the bottom. For example, the upper end portion of the pile has a length of less than 50% of the length of the pile or less than 25% of the length of the pile.

In a practical embodiment the assembly further comprises a follower for transmitting hammering energy from the hammer to the pile, wherein the soil remover is mounted to the follower. The follower may be re-used after driving a pile into the bottom, whereas the follower typically fits to the piles to be driven in order to quickly prepare the assembly for a hammering action. When the soil remover is mounted to the follower it is not necessary to install it inside the pile separately.

The soil remover may have a centring element which fits to the pile. This means that the soil remover automatically has a correct position with respect to the pile upon placing the follower onto a pile. For example, the soil remover may slidably fit in the pile.

In a practical embodiment the follower comprises a tubular transmission portion for transmitting hammering energy from the hammer to the pile, wherein the soil remover is displaceable with respect to the transmission portion in at least a longitudinal direction of the pile. The soil remover may suspend from the transmission portion, for example by cables. This prevents the soil remover from being damaged due to absorbing hammering energy.

The soil remover may comprise a fluid jet, but numerous alternative types of removers are conceivable, for example mechanical excavators such as knives, screws, scoops or the like. High pressure fluid jets can eject a fluid into the bottom material inside the pile such that the sediment is cut and dislodged. The fluid jets may have different nozzle types, for example cutting nozzles and fragmenting nozzles.

Preferably, the assembly further comprises a soil discharger for discharging removed soil from the inner side of the pile to the outer side thereof.

In case of the presence of a follower the soil discharger may comprise a through-hole in the follower through which removed soil can be discharged, preferably via a discharge tube.

In an alternative embodiment in which the soil remover comprises a fluid jet and the follower slidably fits into the pile, the fluid jet is located such that the fluid is pressed between an outer circumference of the follower and an inner wall of the pile. For example, the follower comprises a centring bush which fits in a pile, whereas one or more fluid jets are mounted to the follower and press fluid between the centring bush and the pile. This avoids accumulation of soil material between the centring bush and the pile such that the follower can be pulled out from the pile easily after installing the pile.

Another aspect of the invention is also related to a follower for transmitting hammering energy from an anvil of a pile driver to a tubular pile to be inserted into a bottom, which comprises a tubular transmission portion including an anvil contact surface for receiving hammering energy from the anvil and a soil remover for removing sediment inside the pile, which soil remover is located below the anvil contact surface.

The follower can be used like conventional followers, but the presence of the soil remover provides the opportunity to loosen soil within the upper portion of the pile as soon as the upper portion of the pile approaches the bottom.

In a preferred embodiment the soil remover is displaceable with respect to the transmission portion in at least a longitudinal direction thereof in order to protect the soil remover against damage due to absorbing hammering energy. For example, the soil remover may be mounted resiliently to the transmission portion.

The soil remover may comprise a centring element to be fit to a pile for positioning the transmission portion to the pile. In practice the centring element may be adapted such that it fits inside the pile to be inserted into the bottom. It may be located below the transmission portion of the follower.

The centring element may be slidable with respect to the transmission portion in longitudinal direction thereof. This means that the centring element is displaceable with respect to the transmission portion in longitudinal direction thereof, whereas the centring element has a fixed position with respect to the transmission portion in transverse direction thereof. The centring element may also function as a centring means for easily fitting the follower to a pile. This means that the transmission portion can be placed easily on the pile whereas the soil remover is automatically located correctly at the same time. Therefore, the centring element may have such a circumference that it slidably fits in a tubular pile.

BRIEF DESCRIPTION OF THE DRAWINGS

Aspects of the invention will hereafter be elucidated with reference to very schematic drawings showing embodiments of the invention by way of example.

DETAILED DESCRIPTION OF ILLUSTRATIVE EMBODIMENT

Figures 1, 2, 3:
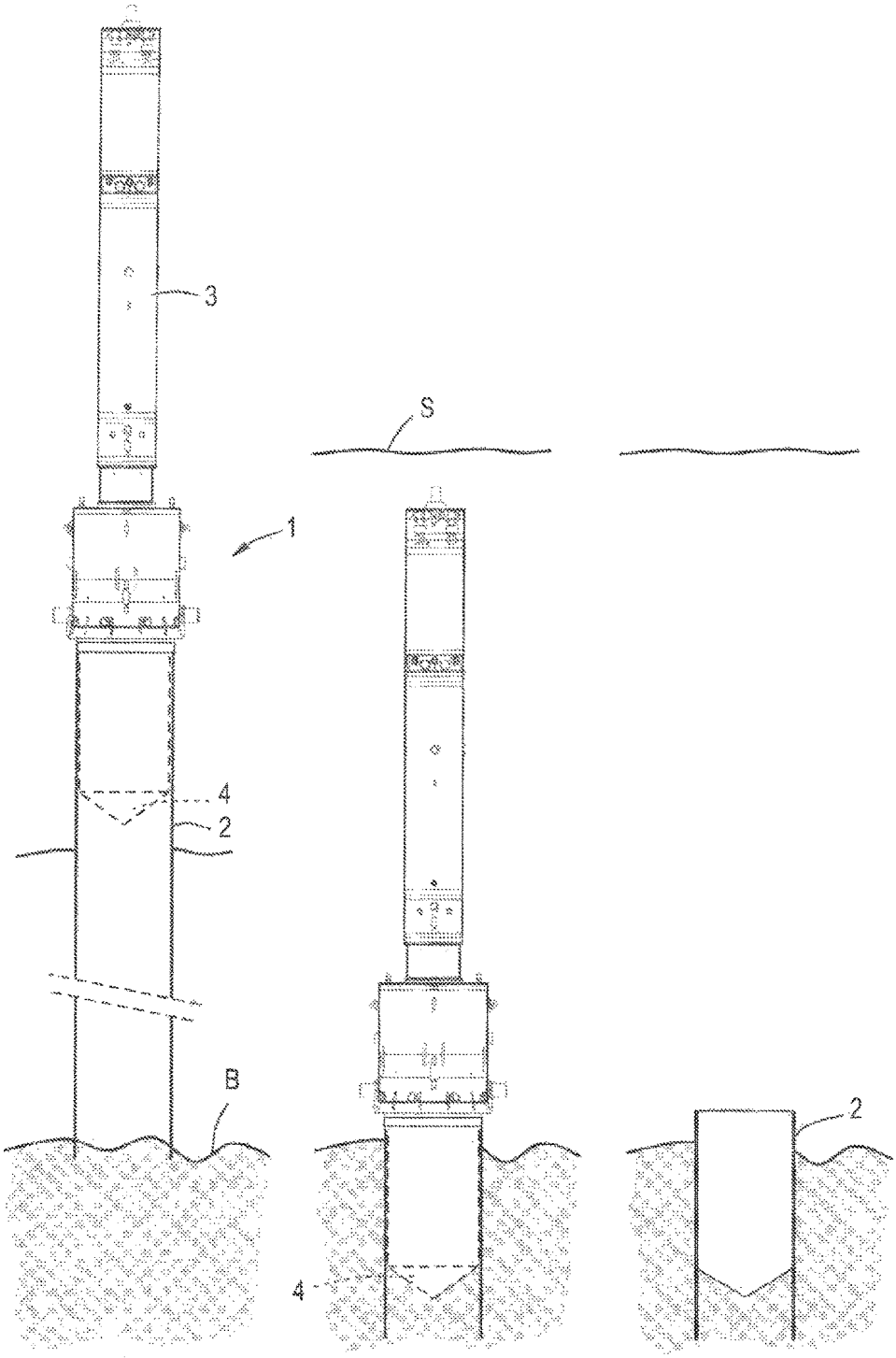
FIG. 1 is a side view and a partly sectional view of an embodiment of a pile driving assembly, showing the assembly in assembled operating condition at the beginning of driving a pile into the bottom.
FIG. 2 is a similar view as FIG. 1, but showing the assembly at the end of driving the pile into the bottom.
FIG. 3 is a similar view as FIG. 2, but showing a disassembled condition.
Figure 4:
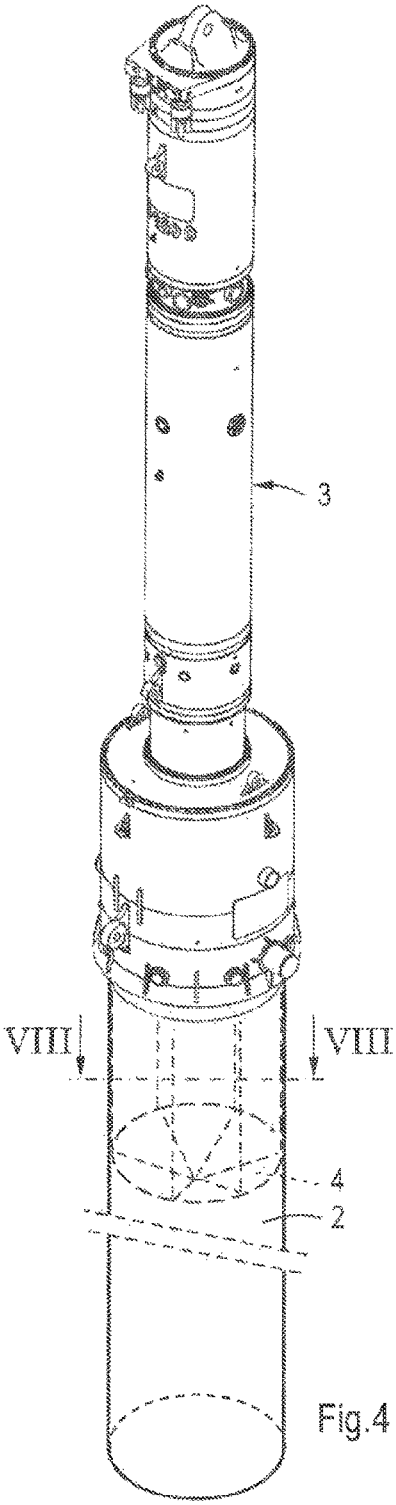
FIG. 4 is a perspective view of a part of the embodiment as shown in FIG. 1 on a larger scale.
Figure 5:
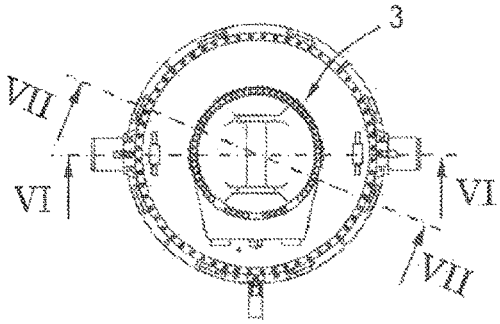
FIG. 5 is a plan view of the embodiment as shown in FIG. 4.
Figure 8:
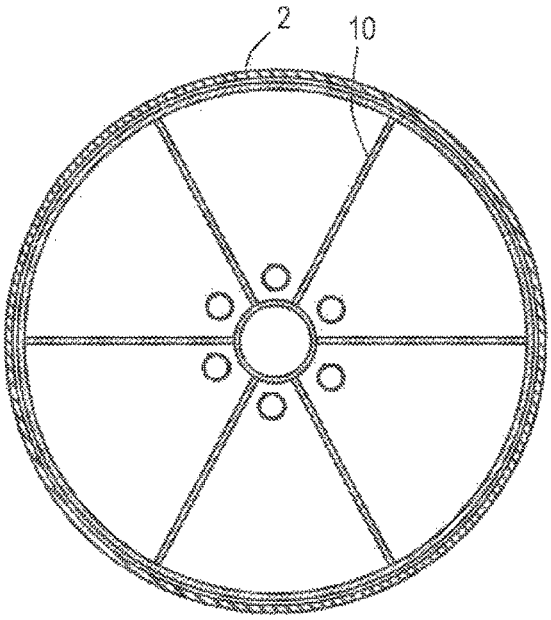
FIG. 8 is an enlarged sectional view along the line VIII-VIII in FIG. 4.

FIG. 1 shows an embodiment of a pile driving assembly 1. The pile driving assembly 1 is shown in assembled operating condition in a situation at a site where a tubular pile 2 must be installed in an underwater bottom B. The water level is indicated by reference sign S in FIG. 1. In this case the pile 2 has a circular cross-section. Its diameter may be 2.5 m and its length may be 40 m, for example, but numerous alternative dimensions are conceivable.

The embodiment of the pile driving assembly 1 as shown in FIGS. 1-8 comprises the pile 2, a hammer in the form of a hydraulic driver 3 for driving the pile 2 into the bottom B and a soil remover 4 for removing sediment within an upper portion of the pile 2 during a final period of driving the pile 2 into the bottom B. The hydraulic driver 3 is connectable to a power pack on board of a surface vessel (not shown). The hydraulic driver 3 can be hoisted by a hoisting device such as a crane (not shown), which is for example placed on the surface vessel. During a first period of driving, the sediment within the pile 2 substantially remains at its initial level with respect to the rest of the bottom B as shown in FIG. 1. When the upper portion of the pile 2 approaches the bottom B the soil remover 4 will start to remove bottom material within the pile 2 as illustrated in FIG. 2.

In the final position of the pile 2 its upper end is still at a distance above the bottom B. However, due to the relative position of the soil remover 4 in the pile 2 the level of the bottom material inside the pile 2 has become lower than outside the pile 2, which is illustrated in the disassembled condition according to FIG. 3.

The pile 2 is driven into the bottom B by the hydraulic driver 3. FIGS. 2 and 3 show a final stage of driving the pile 2 into the bottom B. In a next step (not shown) a leg of a jacket, for example for a wind turbine, can be placed within the upper portion of the pile 2, after which grout may be added to the pile 2 in order to secure the jacket leg to the pile 2. Other applications are conceivable for using the pile 2 of which the upper portion is free from bottom material.

Figure 6:
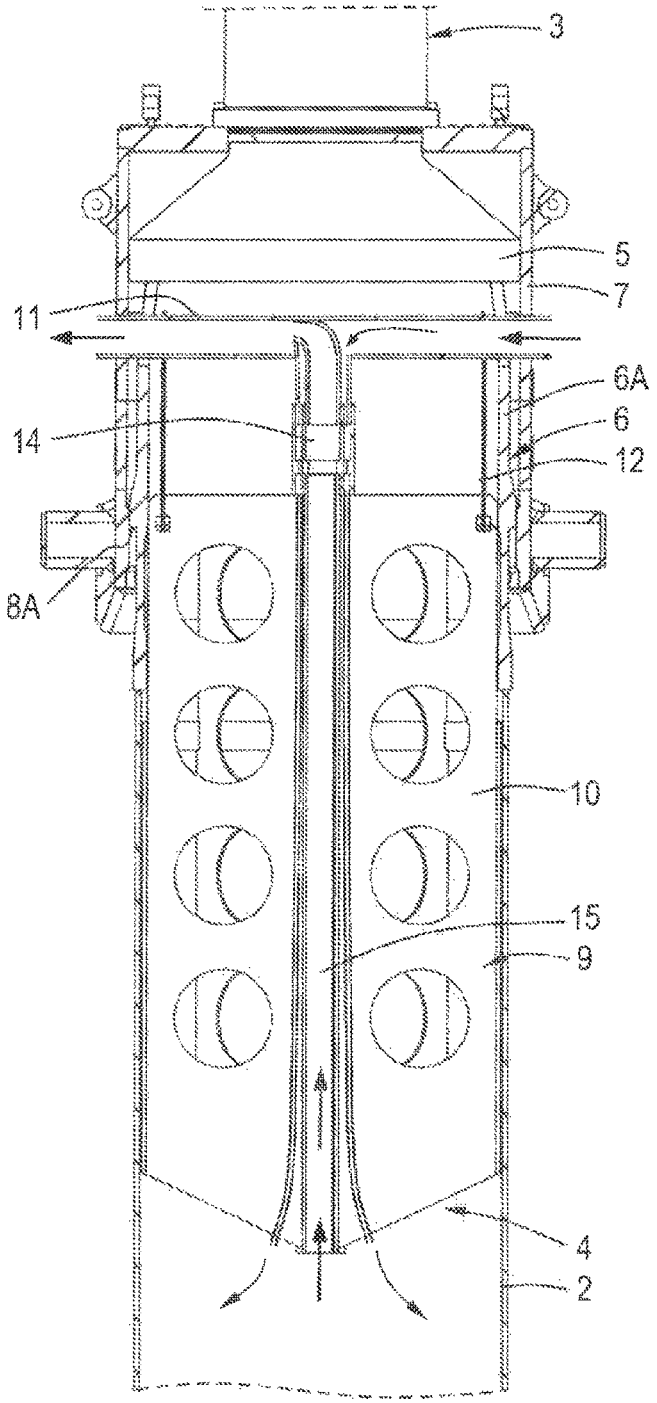
FIG. 6 is an enlarged sectional view along the line VI-VI in FIG. 5.
Figure 7:
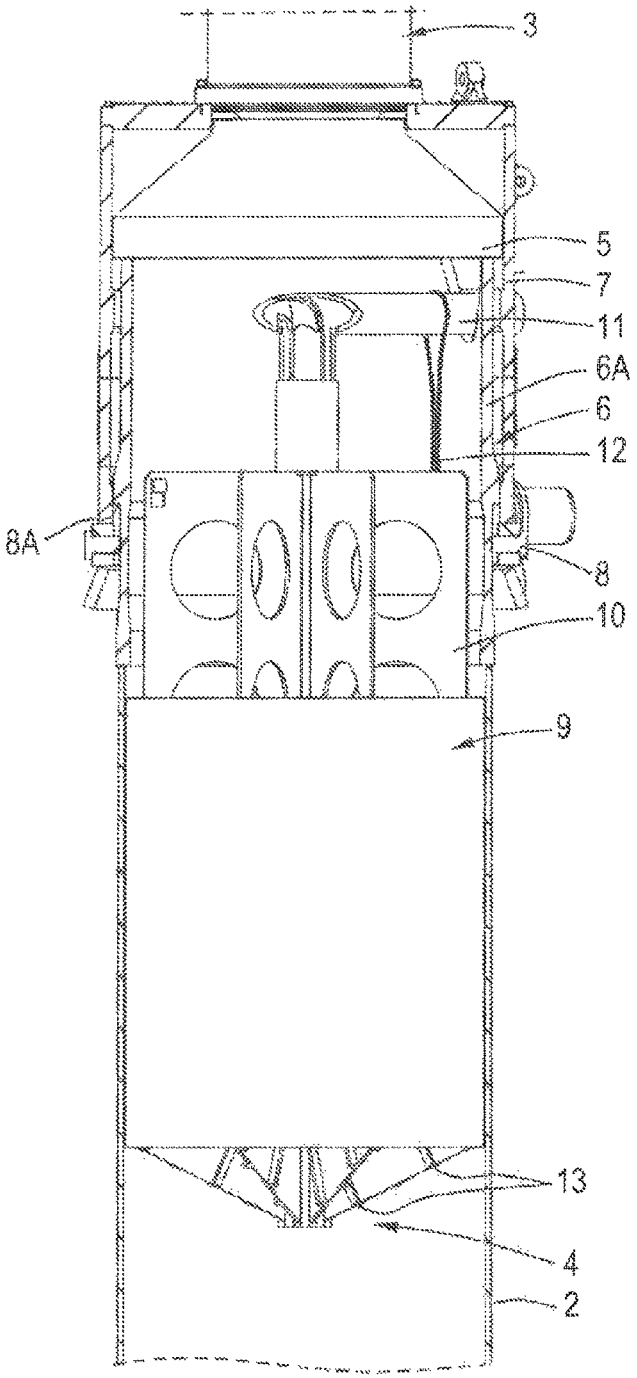
FIG. 7 is an enlarged sectional view along the line VII-VII in FIG. 5.
Figure 9:
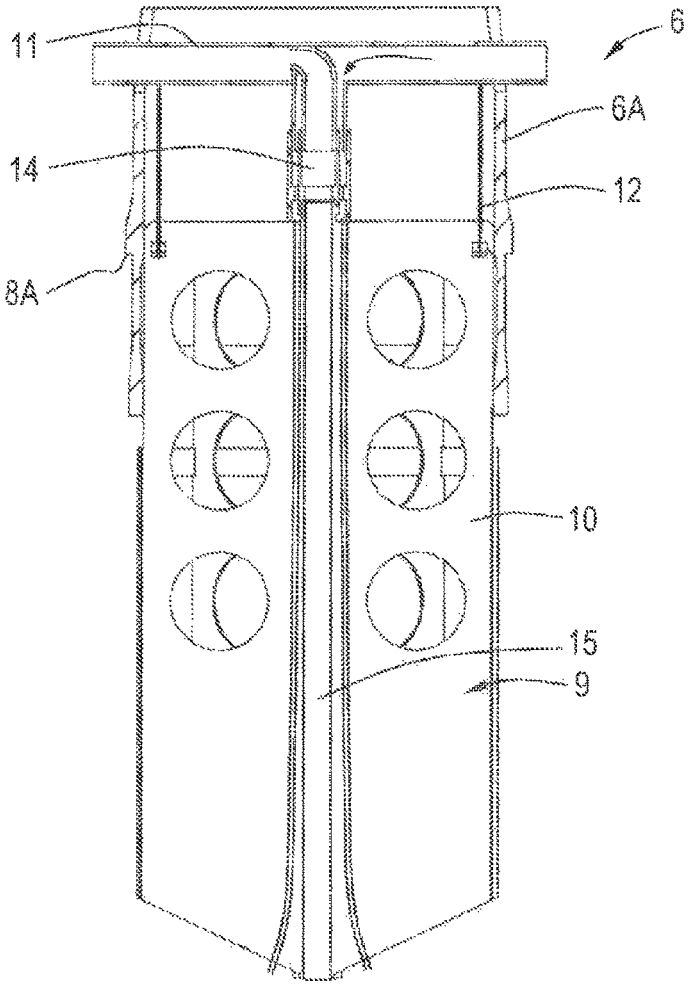
FIG. 9 is a similar view as FIG. 6, but showing the follower as a separate unit.

FIGS. 4-8 show the pile driving assembly 1 in more detail. FIGS. 6 and 7 show an anvil 5 at the lower part of the hydraulic driver 3. The anvil 5 rests on an upper side of a follower 6. The follower is depicted in FIG. 9 as a separate unit. The follower 6 has a tubular transmission portion 6A which rests on the upper end of the pile 2. The upper side of the transmission portion 6A constitutes an anvil contact surface for receiving hammering energy from the anvil 5. Under operating conditions the transmission portion 6A transmits hammering energy from the anvil 5 to the pile 2. The lower part of the hydraulic driver 3 is provided with a tubular sleeve 7 which surrounds the anvil 5 and a part of the follower 6. The sleeve 7 comprises a number of pins 8 at its circumference which protrude at its inner wall for supporting a circumferential protrusion 8A of the transmission portion 6A upon lifting the follower 6 by the sleeve 7, for example in case of removing the hydraulic driver 3 from the pile 2 after finishing the driving action. During driving the pile 2 into the bottom B there is a vertical distance between the pins 8 and the protrusion 8A in order to avoid transmission of hammering energy directly to the sleeve 7 via the pins 8.

The follower 6 comprises a centring element 9 which fits closely in the pile 2. The centring element 9 has a fixed position with respect to the transmission portion 6A of the follower 6 in radial direction and serves to position the transmission portion 6A easily onto the pile 2 before hammering, on the one hand, and to position the soil remover 4 at the correct position, on the other hand. The centring element 9 has radial plates 10 surrounded by a bush which fits slidably in the pile 2. The centring element 9 suspends from a horizontal pipe 11 at the top of the follower 6 via cables 12. Lower sections of the plates 10 which are located inside the surrounding bush are fixed to the bush at their radial outer ends, whereas upper sections of the plates 10 which protrude above the bush can slide along the inner wall of the transmission portion 6A in longitudinal direction thereof. As a consequence, the bush has a substantially fixed position with respect to the transmission portion 6A in radial direction thereof, but it is displaceable with respect to the transmission portion 6A in vertical direction due to its suspension by means of the cables 12.

In the embodiment as shown in the figures, the soil remover 4 of the pile driving assembly 1 is integrated in the follower 6. The soil remover 4 comprises a fluid jet having high pressure jet nozzles 13 for electing a fluid into the bottom material inside the pile 2. This cuts and dislodges the bottom material. The jet nozzles 13 and their fluid supply lines are mounted to the radial plates 10. The fluid can be supplied from outside via the pipe 11 extending through holes in the sleeve 7 and the transmission portion 6A as shown by arrows in FIG. 6. Since the centring element 9 is vertically displaceable with respect to the transmission portion 6A of the follower 6 there is a flexible coupling 14 to absorb movements between the fluid supply lines to the jet nozzles 13 and the pipe 11.

The jet nozzles 13 project below the bottom side of the surrounding bush of the centring element 9 and are positioned in a conical arrangement. This creates a conical shape in the bottom material inside the pile 2 as shown in FIG. 3. The soil remover 4 can be operated during pile driving and started when the upper portion of the pile 2 approaches the bottom B.

The embodiment of the pile drying assembly 1 as shown in the figures is also provided with a soil discharger for discharging removed soil from the inner side of the pile 2 to the outer side thereof. The soil discharger comprises a discharge tube 15 extending upwardly at the centre of the follower 6 from its entrance at the bottom side of the follower 6. At the transmission portion 6A of the follower 6 the discharge tube 15 bends towards the circumferential outer side of the sleeve 7 and runs through respective holes in the transmission portion 6A and the sleeve 7 to a suction device (not shown). Alternatively, a pump at its inlet at the follower 6 may be applied. Similar to the fluid supply lines, the flexible coupling 14 also allows movements between the horizontal pipe 11 and the vertical discharge tube 15.

Figure 10:
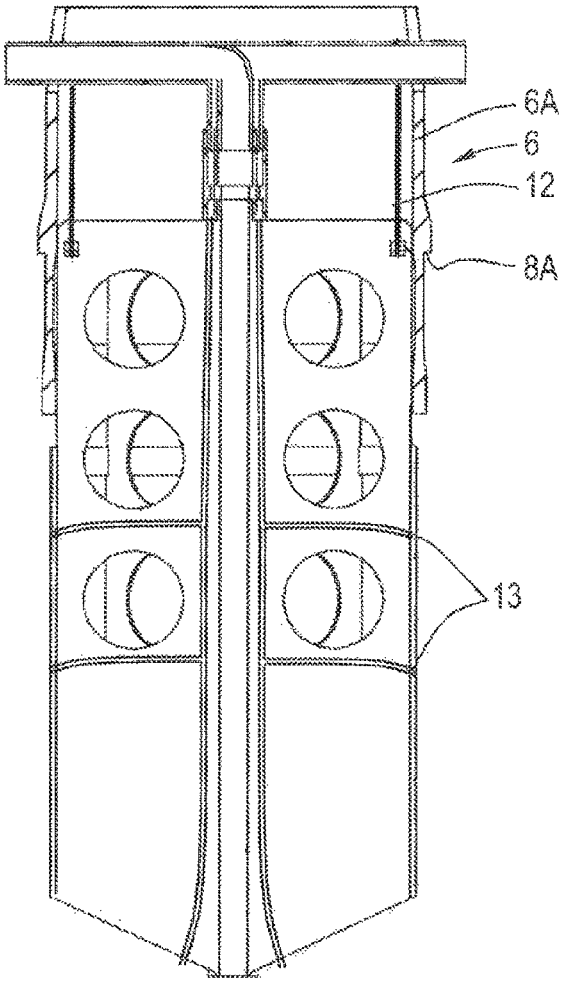
FIG. 10 is a similar view as FIG. 9, but showing an alternative embodiment.

FIG. 10 shows an alternative embodiment of the follower 6, in which the jet nozzles 13 of the soil remover 4 are located at the surrounding bush of the centring element 9. The jet nozzles 13 are directed such that during pile driving fluid is pressed between the bush of the centring element 9 and the pile 2. This avoids accumulation of soil material between the follower 6 and the pile 2 which simplifies removal of the follower 6 from a pile 2 after the pile 2 has been installed. It is noted that the fluid jet nozzles 13 at the circumference of the follower 6 can be applied independently from the presence of jet nozzles 13 at the bottom of the follower 6 and of the discharge tube 15, such as described in the embodiment of the pile driving assembly and the follower as shown in FIGS. 1-9.

From the foregoing, it will be clear that the invention provides an efficient pile driving assembly because of the possibility of removing sediment from the upper portion of the pile during driving that portion into the bottom.

The invention is not limited to the embodiments shown in the drawings and described hereinbefore, which may be varied in different manners within the scope of the claims and their technical equivalents.

The invention claimed is:

1. A pile driving assembly for installing a pile in an underwater bottom, comprising, a hammer configured to drive the pile into the underwater bottom, a soil remover configured to remove soil from inside the pile, wherein the soil remover is located below the hammer and remote from a lower end of the pile in an assembled operating condition, a follower having a tubular transmission portion configured to transmit hammering energy from the hammer to the pile, wherein the follower supports the weight of the soil remover in the pile, and wherein the soil remover is displaceable with respect to the transmission portion in at least a longitudinal direction of the pile.

2. The pile driving assembly according to claim 1, wherein the soil remover is located at an upper end portion of the pile.

3. The pile driving assembly according to claim 2, wherein the upper end portion of the pile has a length of less than 50% of the length of the pile.

4. The pile driving assembly according to claim 2, wherein the soil remover has a centring element fitting to the pile.

5. The pile driving assembly according to claim 2, wherein the upper end portion of the pile has a length of less than 25% of the length of the pile.

6. The pile driving assembly according to claim 1, wherein the soil remover comprises a fluid jet.

7. The pile driving assembly according to claim 1, wherein the assembly further comprises a soil discharger configured to discharge removed soil from the inner side of the pile to the outer side thereof.

8. The pile driving assembly according to claim 7, wherein the soil discharger comprises a through-hole in the follower through which removed soil is discharged.

9. The pile driving assembly according to claim 1, wherein the follower slidably fits into the pile and the fluid jet is located such that the fluid is pressed between an outer circumference of the follower and an inner wall of the pile.

10. A follower for transmitting hammering energy from an anvil of a pile driver to a tubular pile to be inserted into a bottom, comprising: a tubular transmission portion removably coupled to the tubular pile, the tubular transmission portion including an anvil contact surface configured to receive hammering energy from the anvils and a soil remover configured to remove sediment inside the pile, wherein the tubular transmission portion supports the weight of the soil remover from above and the soil remover is displaceable with respect to the transmission portion in at least a longitudinal direction thereof, and wherein soil remover is located below the anvil contact surface.

11. The follower according to claim 10, wherein the soil remover comprises a centring element to be fit to a pile for positioning the soil remover to the pile.

12. The follower according to claim 11, wherein the centring element is slidable with respect to the transmission portion in longitudinal direction thereof.

13. The follower according to claim 12, wherein the centring element has such a circumference that it slidably fits in a tubular pile.

14. The follower of claim 13 wherein the centring includes a bush.

* * * * *